US006379163B1

(12) United States Patent
Yu

(10) Patent No.: US 6,379,163 B1
(45) Date of Patent: Apr. 30, 2002

(54) GROUNDED STACKED ELECTRICAL CARD CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/730,035

(22) Filed: Dec. 4, 2000

(30) Foreign Application Priority Data

Nov. 17, 2000 (TW) ..... 089219993

(51) Int. Cl.[7] ..... H01R 13/648
(52) U.S. Cl. ..... 439/95; 439/541.5
(58) Field of Search ..... 439/95, 541.5, 439/64, 159, 160, 607–610, 79

(56) References Cited

U.S. PATENT DOCUMENTS 5,795,190 A * 8/1998 Ono ..... 439/541.5
5,967,803 A * 10/1999 Ho ..... 439/541.5
6,071,149 A * 6/2000 Hara ..... 439/541.5
6,129,564 A * 10/2000 Kawamae et al. ..... 439/95
6,132,243 A * 10/2000 Hirata et al. ..... 439/79
6,174,197 B1 * 1/2001 Hirata et al. ..... 439/541.5
6,183,273 B1 * 2/2001 Yu et al. ..... 439/541.5

* cited by examiner

*Primary Examiner*—Gary F. Paumen
(74) *Attorney, Agent, or Firm*—Wei Te Chung

(57) ABSTRACT

A stacked electrical card connector (1) includes a first electrical card connector (2), a second electrical card connector (3), a grounding element (4), a pair of card ejection elements 7, 8, and an upper and a lower shielding plates 5, 6. The grounding element is assembled to the first electrical card connector and comprises a first contacting portion (42), a second contacting portion (44) and a transition portion (46) connecting the first and second contacting portions. The first contacting portion is electrically connected to the upper shielding plate and grounds an electronic card inserted into the first electrical card connector. The second contacting portion grounds an electronic card inserted into the second electrical card connector. The first contacts each comprise a mounting tail (222) and the transition portion of the grounding element defines an opening (45) for the mounting tails of the first contacts to extend through.

2 Claims, 4 Drawing Sheets

GROUNDED STACKED ELECTRICAL CARD CONNECTOR

BACKGROUND OF THE INVENTION

1. Field of the Invention

The present invention relates to an electrical card connector, and particularly to a stacked electrical card connector having a conductive grounding element.

2. Description of the Related Art

Electrical card connectors are mounted on printed circuit boards for electrically connecting electronic cards received therein with electrical circuits of the printed circuit boards. The electrical card connectors usually have grounding elements which are electrically connected to grounding pads of the electronic cards received therein and to grounding circuits of the printed circuit boards, thereby providing a grounding connection for the electronic card and the card connector.

Stacked electrical card connectors have at least two electrical card connectors stacked one on top of the other. Grounding elements of a stacked electrical card connector are usually separatedly disposed, i.e., one card connector corresponds to one grounding element. Therefore, many elements may be needed for configuring a single stacked electrical card connector. This makes assembly more time-consuming and costly. Other stacked electrical card connectors include grounding elements which are integrally formed together in one piece. However, presently used integral grounding elements act to shield mounting tails of electrical contacts of the stacked electrical card connectors and thus when soldering of the mounting tails during a Surface Mounting Technology (SMT) process fails, repair of the faulty solder joints difficult, or even impossible.

Therefore, an improved stacked electrical card connector is desired to overcome the disadvantages of the prior art.

SUMMARY OF THE INVENTION

A major object of the present invention is to provide a stacked electrical card connector which is compact and which allows easy repair of faultily soldered mounting tails of electrical contacts thereof following an SMT process.

A stacked electrical card connector in accordance with the present invention comprises a first electrical card connector, a second electrical card connector, a conductive grounding element, a pair of card ejection elements and an upper and a lower shielding plates. The first and second electrical card connectors each have an insulative housing and a plurality of electrical contacts mounted in the insulative housings. The grounding element substantially encloses the first electrical card connector and comprises a first contacting portion, a second contacting portion and a transition portion connecting the first and second contacting portions together. The first contacting portion contacts one of the shielding plates and one of the electronic cards inserted into the stacked electrical card connector. The second contacting portion contacts another of the electronic cards inserted into the stacked electrical card connector. The transition portion defines an opening for mounting tails of the electrical contacts of the first electrical card connector to extend therethrough.

Other objects, advantages and novel features of the invention will become more apparent from the following detailed description of the present embodiment when taken in conjunction with the accompanying drawings.

DETAILED DESCRIPTION OF THE INVENTION

Figure 1:
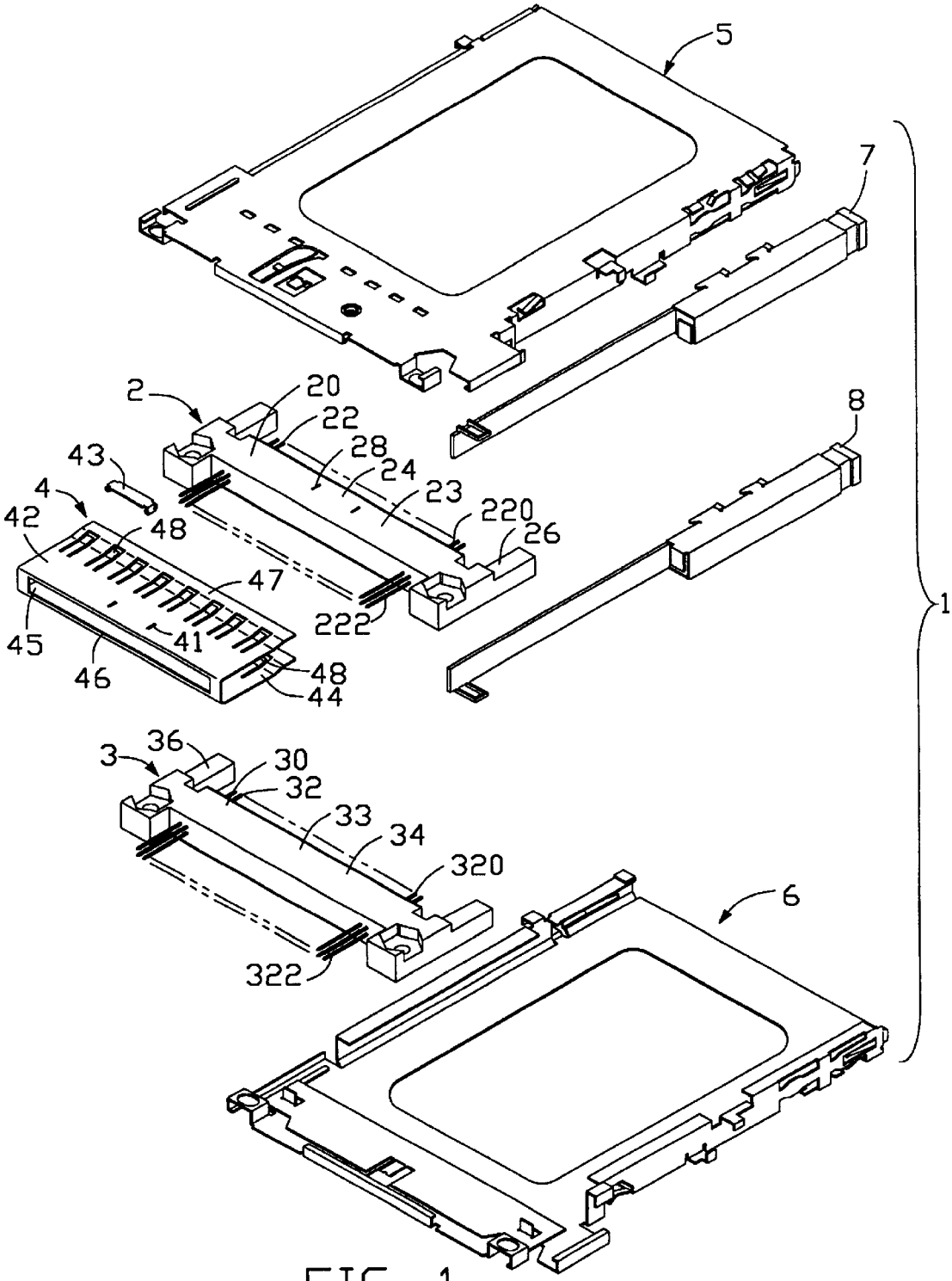
FIG. 1 is an exploded view of a stacked electrical card connector in accordance with the present invention.

Referring to FIG. 1, a stacked electrical card connector 1 in accordance with the present invention comprises a first electrical card connector 2, a second electrical card connector 3, a conductive grounding element 4, a fastener 43, an upper and a lower conductive shielding plates 5, 6 and a pair of card ejection elements 7, 8.

The first electrical card connector 2 comprises an insulative first housing 20 and a plurality of electrical first contacts 22. The first housing 20 comprises an elongated base portion 23 and a pair of parallel arms 26 extending forward and backward from two opposite ends of the base portion 23. The base portion 23 defines a pair of slits 28 on an upper surface 24 thereof. The first contacts 22 extend through the base portion 23 in a direction parallel to the arms 26 and each comprises an engaging portion 220 extending forward beyond the base portion 23 and a mounting tail 222 extending rearward beyond the base portion 23.

The second electrical card connector 3 is similar to the first electrical card connector 2 and comprises an insulative second housing 30 and a plurality of electrical second contacts 32. The second housing 30 comprises an elongated base portion 33 defining an upper surface 34 thereon and a pair of parallel arms 36 extending forward and backward from two opposite ends of the base portion 33. The second contacts 32 extend through the base portion 33 and parallel to the arms 36. Each second contact 32 comprises an engaging portion 320 extending forwardly beyond the base portion 33 and a mounting tail 322 extending rearwardly beyond the base portion 33.

Figure 3:
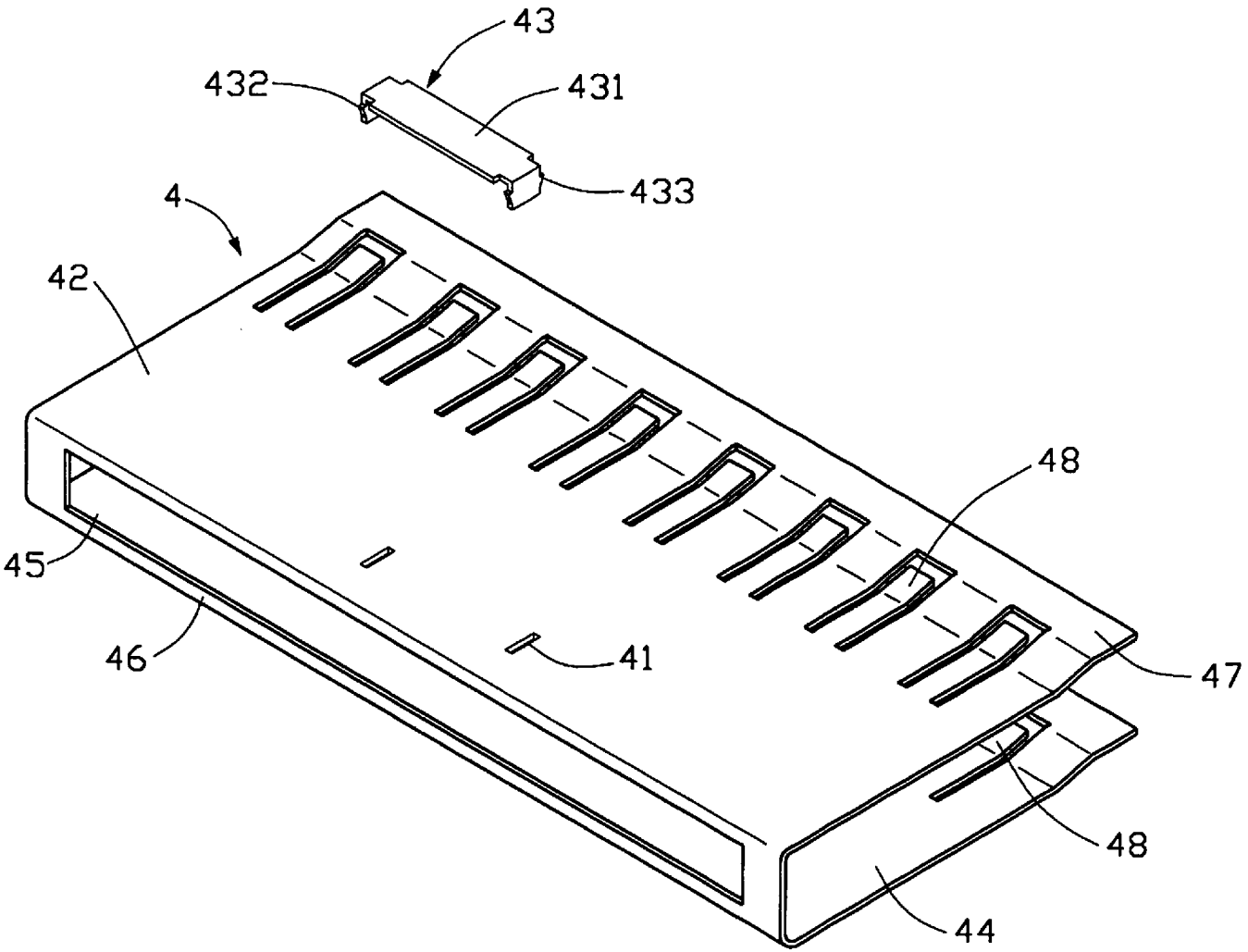
FIG. 3 is a perspective view of a grounding element and a fastener of the stacked electrical card connector of FIG. 1.

Referring also to FIG. 3, the grounding element 4 comprises a first contacting portion 42, a second contacting portion 44 parallel to the first contacting portion 42 and a transition portion 46 perpendicular to and connecting the first and second contacting portions 42, 44 together. The first contacting portion 42 defines an upper contacting surface 47 on a front edge thereof and a pair of slots 41 adjacent to a rear edge thereof. The slots 41 are dimensioned and spaced from each other to correspond to the slits 28 of the first housing 20 of the first electrical card connector 2. Each of the first and second contacting portions 42, 44 comprises a plurality of tongues 48 adjacent to a front edge thereof. The transition portion 46 defines an opening 45 extending substantially the whole length and width of the transitional portion 46.

The fastener 43 comprises a body portion 431 and a pair of feet 432 depending perpendicularly from opposite ends of the body portion 431. Each foot 432 forms a pair of barbs 433 thereon. The feet 432 are configured and spaced from each other to correspond to the slits 28 of the first housing 20 and the slots 41 of the grounding element 4.

The conductive upper and lower shielding plates 5 and 6 are commonly known to persons skilled in the pertinent art and each forms an engaging mechanism (not labeled) on a periphery thereof The card ejection elements 7 and 8 are also commonly known to persons skilled in the pertinent art and they are similar to one another. Detailed descriptions of the card ejecting elements 7 and 8 are omitted herein.

Figure 2:
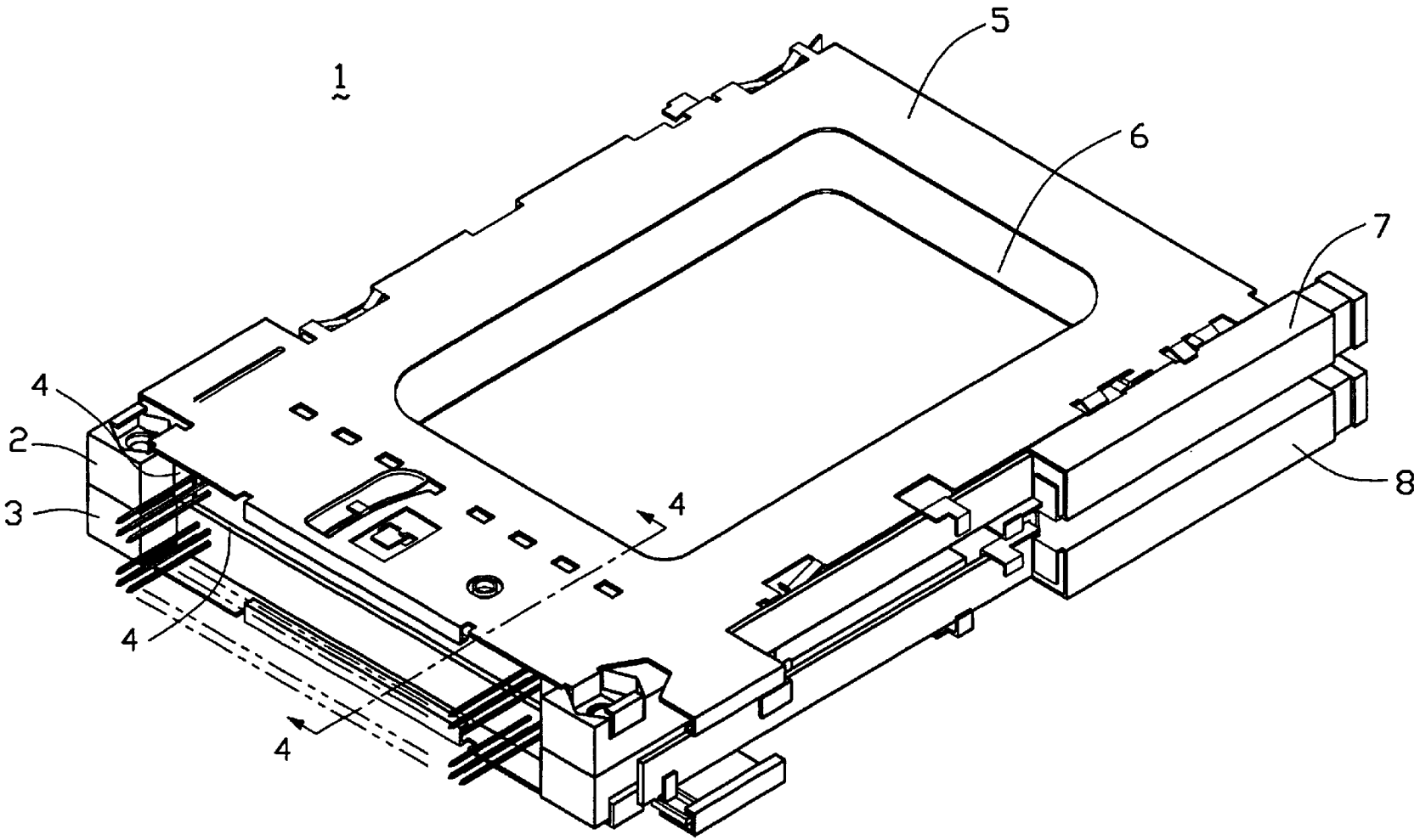
FIG. 2 is an assembled perspective view of FIG. 1.
Figure 4:
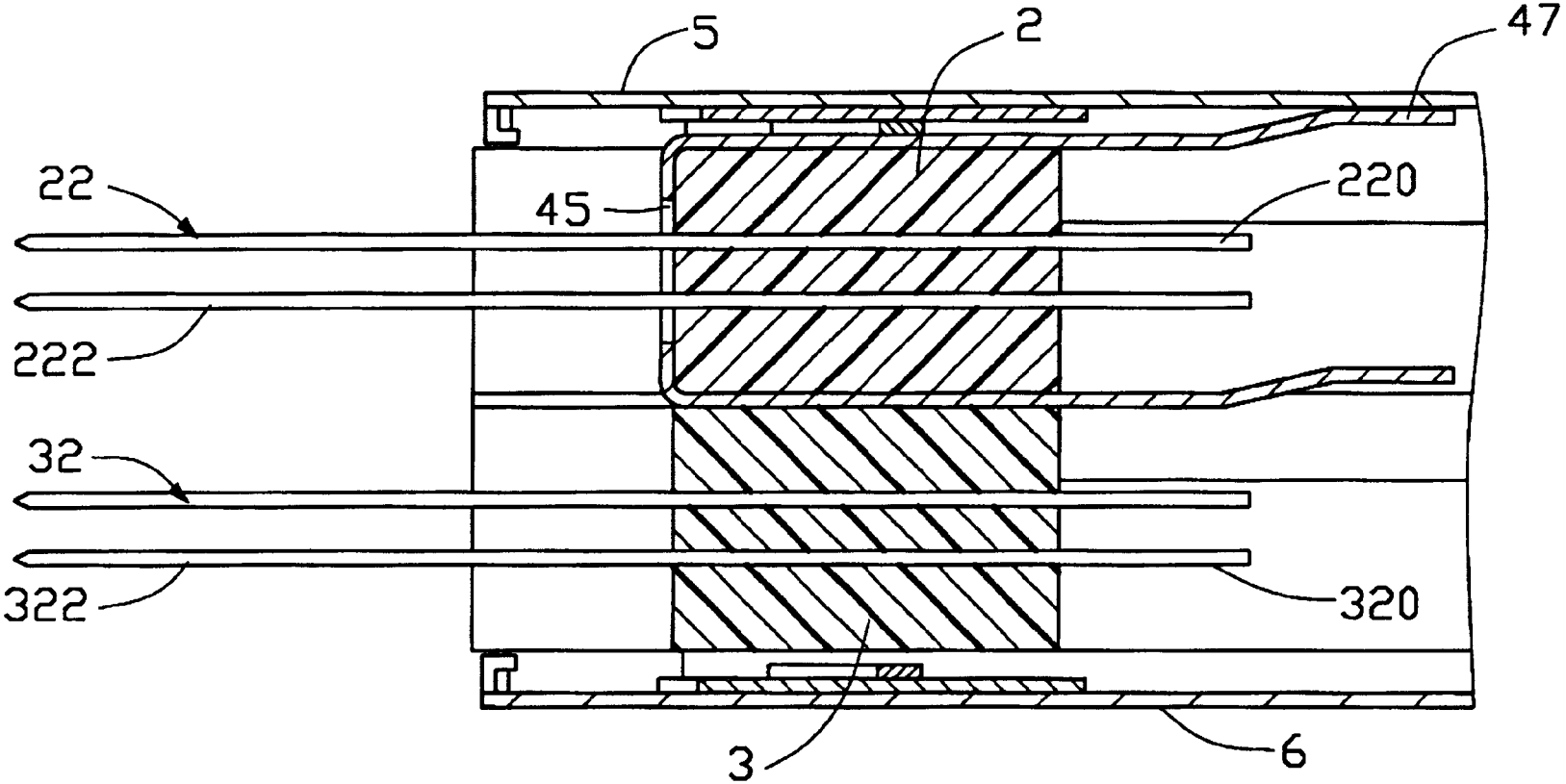
FIG. 4 is a cross-sectional view taken along line 4—4 of FIG. 2.

Referring also to FIGS. 2 and 4, in assembly, the grounding element 4 is assembled to the first electrical card connector 2. The grounding element 4 encloses an upper, a rear and a lower side of the base portion 23 of the first housing 20. The engaging portions 220 of the first contacts 22 are accommodated between the first and second contacting portions 42, 44 while the mounting tails 222 of the first contacts 22 extend through the opening 45 of the transition portion 46 and beyond the grounding element 4. The feet 432 of the fastener 43 extend through the slots 41 of the first contacting portion 42 of the grounding element 4 into the slits 28 of the first housing 20. The barbs 433 provide a retention force between the fastener 43 and the first housing 20 thereby reliably retaining the grounding element 4 to the first housing 20. The second electrical card connector 3 is stacked below the first electrical card connector 2 with the upper surface 34 thereof abutting against the second contacting portion 44 of the grounding element 4. The card ejection elements 7 and 8 are assembled to the upper and lower shielding plates 5 and 6, respectively, in one vertical row. The upper and lower shielding plates 5 and 6 are assembled to the first and second electrical card connectors 2 and 3, respectively, in a way commonly known in the pertinent art such that the card ejection elements 7 and 8 are aligned in a vertical column. The upper contacting surface 47 of the grounding element 4 abuts and is electrically connected with the upper shielding plate 5. The upper and lower shielding plates 5, 6 are electrically connected with each other in a way commonly known in the pertinent art.

In use, Electrostatic Discharge (ESD) and unwanted signals impinging on an electronic card (not shown) received in the first electrical card connector 2 are transmitted from grounding pads of the electronic card by way of the first contacting portion 42 and the upper and lower shielding plates 5 and 6 to grounding circuits on a printed circuit board (not shown). Electrostatic Discharge (ESD) and unwanted signals impinging on an electronic card (not shown) received in the second electrical card connector 3 are transmitted from grounding pads of the electronic card by way of the second and first contacting portions 44 and 42 and the upper and lower shielding plates 5 and 6 to grounding circuits on the printed circuit board. The first and second contacting portions 42, 44 of the grounding element 4 shields engaging portions 220, 320 of electrical contacts 22, 32 of the first and second electrical connectors 2, 3 and also provides in a one piece grounding element for the entire stacked electrical card connector, thereby reducing the number of elements to be manufactured and assembled in the stacked electrical card connector 1, saving assembling time and cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector comprising:

a first electrical card connector comprising an insulative first housing and a plurality of electrical first contacts, the first housing comprising a base portion and a pair of parallel arms extending from two opposite ends of the base portion, the first contacts extending parallel to the arms through the base portion of the first housing, each first contact comprising a mounting tail and an engaging portion extending beyond the base portion of the first housing;

a second electrical card connector comprising an insulative second housing and a plurality of electrical second contacts, the second housing comprising a base portion and a pair of parallel arms extending from two opposite ends of the base portion, the second contacts extending parallel to the arms through the base portion of the second housing, each second contact comprising a mounting tail and an engaging portion extending beyond the base portion of the second housing;

a conductive grounding element enclosing the first electrical card connector, the grounding element comprising a first contacting portion, a second contacting portion and a transition portion connecting the first and second contacting portions, the first and second contacting portions shielding the engaging portions of the first and second contacts, the transition portion defining an opening for the mounting tails of the electrical first contacts of the first electrical card connector to extend therethrough and beyond the grounding element; and a conductive shielding plate enclosing the first and the second electrical card connectors and electrically connecting with the grounding element;

further comprising a pair of card ejection elements assembled to the conductive shielding plate;

further comprising a fastener for reliably attaching the grounding element to the first housing of the first electrical card connector;

wherein the grounding element defines a pair of slots and the first housing defines a pair of slits on the base portion thereof, the fastener having a pair of feet extending through the slots of the grounding element into the slits of the first housing;

wherein the feet of the fastener each have a pair of barbs thereon;

wherein each of the first and second contacting portions has a plurality of tongues thereon.

2. An electrical assembly, comprising:

a first electrical card connector comprising an insulative first housing and a plurality of electrical first contacts, the first housing comprising a base portion and a pair of parallel arms extending forwardly and backwardly from two opposite ends of the base portion, the first contacts extending through the base portion of the first housing and each comprising an engaging portion projecting forwardly beyond the base portion of the first housing and a mounting tail projecting rearwardly beyond the base portion of the first housing;

a second electrical card connector comprising an insulative second housing and a plurality of electrical second contacts, the second housing comprising a base portion and a pair of parallel arms extending forwardly and backwardly from two opposite ends of the base portion, the second contacts extending through the base portion of the second housing and each comprising an engaging portion projecting forwardly beyond the base portion of the second housing and a mounting tail projecting rearwardly beyond the base portion of the second housing;

a conductive grounding element assembled to the first electrical card connector, the grounding element comprising a first contacting portion, a second contacting portion and a transition portion connecting the first and second contacting portion, the first and second contacting portions accommodating the engaging portions of the first contact therebetween, the transition portion defining an opening for the mounting tails of the first contacts to extend therethrough and beyond the grounding element;

a conductive shielding plate assembled to the first and second electrical connectors and being electrically connected with the grounding element;

a first electronic card inserted into the first electrical card connector and being electrically connected with the engaging portions of the first contacts, the first electronic card comprising grounding pads thereon electrically connected to the first contacting portion of the grounding element; and a second electronic card inserted into the second electrical card connector and being electrically connected with the engaging portions of the second contacts, the second electronic card comprising grounding pads thereon electrically connected to the second contacting portion of the grounding element;

further comprising a pair of card ejection elements assembled to the conductive shielding plate;

wherein the first and second contacting portions are parallel to each other and the transition portion is perpendicular to the first and second contacting portions;

wherein the second electrical card connector is stacked below the first electrical card connector.

* * * * *